US005160381A

United States Patent [19]

Gervais

[11] Patent Number: 5,160,381

[45] Date of Patent: Nov. 3, 1992

[54] METHOD FOR FORMING ARTIFICIALLY AND RAPIDLY PATINA ON COPPER, PRODUCTS THEREOF AND SOLUTIONS THEREFOR

[75] Inventor: Jocelyn Gervais, Cap-Rouge, Canada

[73] Assignee: Fumigation Maritime Ltée, Cap-Rouge, Canada

[21] Appl. No.: 721,295

[22] Filed: Jun. 26, 1991

[51] Int. Cl.[5] ..... C23C 22/00

[52] U.S. Cl. ..... 148/269; 148/290

[58] Field of Search ..... 148/269

[56] References Cited

U.S. PATENT DOCUMENTS

| | | |
|---|---|---|
| 1,951,304 | 4/1934 | Freeman et al. . |
| 2,587,216 | 9/1952 | Quadrio . |
| 3,152,927 | 2/1964 | Mattsson et al. . |
| 3,434,890 | 6/1969 | Aronberg . |
| 3,473,970 | 11/1969 | Robey . |
| 3,497,401 | 9/1970 | Hanson et al. . |
| 3,725,138 | 7/1973 | Jones . |
| 4,416,940 | 3/1983 | Loye et al. . |

FOREIGN PATENT DOCUMENTS

| | | | |
|---|---|---|---|
| 0001083 | 8/1960 | Japan | 148/269 |
| 0135578 | 7/1985 | Japan | 148/269 |
| 0041150 | 9/1985 | Japan | 148/269 |

OTHER PUBLICATIONS

Colouring Copper, Metal Industry Jan. 19, 1951.

*Primary Examiner*—Sam Silverberg
*Attorney, Agent, or Firm*—Robic

[57] ABSTRACT

A method for artificially forming patina on copper comprising: a) removing any impurity present on the surface of copper substrate; b) polishing the copper substrate with an aqueous solution containing sodium ions, copper ions, acetate ions, chlorine ions, sulphate ions, H+ ions and OH− ions until a brown colour is obtained; c) washing the polished copper substrate having brown colour of step (b), with water and drying; d) gently brushing the copper substrate having been dried according to step (c), washing and thoroughly drying; e) submitting the copper substrate after having been thoroughly dried according to step (d), to a filtered aqueous solution containing copper carbonate, ammonium chloride, copper acetate, arsenic trioxide, copper nitrate and hydrochloric acid until the desired patinated copper substrate is obtained. The invention covers also the products resulting from the method, as well as specific solutions to carry steps (b) and (e).

10 Claims, No Drawings

METHOD FOR FORMING ARTIFICIALLY AND RAPIDLY PATINA ON COPPER, PRODUCTS THEREOF AND SOLUTIONS THEREFOR

BACKGROUND OF THE INVENTION

1. Field of the Invention

This invention relates to a method for artificially and rapidly forming patina on copper substrates, to products therefrom, in particular to such copper substrates as roofing and outside covering, and to new solutions for rapidly forming patina on copper.

2. Description of Related Art

Attempts have been made in order to obtain coloring of copper similar to patina on copper.

For instance in U.S. Pat. No. 1,951,304, dated Mar. 13, 1934, as invented by FREEMAN et al., is disclosed a method producing on the surface of copper and alloys thereof, an adherent green coloration patina by treating the copper or copper alloy with a solution of ammonium sulphate and thereafter exposing to oxygen. In some cases a color is developed which is darker green than that which develops by natural weathering.

In U.S. Pat. No. 2,587,216, dated Feb. 26, 1952, as invented by QUADRIO, is disclosed a method involving the following steps: dipping an object in a bath containing a solution of potassium sulfide, then a second bath of sulphuric acid, drying, then dipping in a third bath containing salt ammoniac, and then coating with shellac and a protective coating.

In U.S. Pat. No. 3,152,927, dated Oct. 13, 1964, as invented by MATTSON et al., is disclosed an agent for the artificial green patination of object comprising an aqueous sludge obtained by admixing an aqueous solution containing copper nitrate, iron sulphate and sodium hydroxide.

In U.S. Pat. No. 3,434,890, dated Mar. 25, 1969, as invented by ARONBERG, is disclosed a process for forming patina involving wetting a copper base alloy with a solution volatile water soluble organic solvent such as alcohol and salts of inorganic acids and primary amines.

In U.S. Pat. No. 3,473,970, dated Oct. 21, 1969, as invented by ROBEY, is disclosed a composition for imparting patina comprising copper sulphate, ammonium sulphate lithium chloride, sodium dichromate, hydrochloric acid, magnesium montmorillonite and water.

In U.S. Pat. No. 3,497,401, dated Feb. 24, 1970, as invented by HANSON et al., is disclosed a method for producing synthetic patina by immersion in an aqueous acidic solution with potassium chlorate and copper sulphate.

In U.S. Pat. No. 3,725,138, dated Apr. 3, 1973, as invented by JONES, is disclosed a patina produced on a copper surface by applying an aqueous acidic solution of ammonium sulphate, sulphamic acid and iron sulphate, drying the solution to form a film on the copper surface. The film is then reacted with the copper surface in a humid atmosphere at a temperature of at least 30° C. for a period of time to form an adhered corrosion product of which a major portion is insolubilized. The soluble parts are then dissolved, thereby developing in the reaction product the color of natural patina.

In U.S. Pat. No. 4,416,940, dated Nov. 22, 1983, as invented by LOYE et al., is disclosed a two step process comprising first applying an opaque pigmented base coat containing a patina color producing colorant to a primed or unprimed substrate, curing the base coat, applying to the cure base coat a non-opaque top coat containing one or more copper color producing additives.

SUMMARY OF THE INVENTION

Broadly stated, the invention is directed to a rapid method for artificially forming patina on copper comprising:

a) removing any impurity present on the surface of a copper substrate;

b) coating said copper substrate with an aqueous solution containing sodium ions, copper ions, acetate ions, chlorine ions, sulphate ions, $H+$ ions and an $OH-$ ions;

c) washing the copper substrate coated as in step (b) with water and drying;

d) gently brushing the copper substrate having been dried according to step (c), washing and drying;

e) coating said copper substrate after having been dried according to step (d), with a aqueous solution containing copper carbonate, ammonium chloride, copper acetate, arsenic trioxide, copper nitrate and hydrochloric acid.

The invention is also directed to new products obtained by the method as defined above and to products for forming patina on copper.

DESCRIPTION OF A PREFERRED EMBODIMENT

The first step of the method involves cleaning of the surface in order to remove any impurity present on the surface of the copper substrate such as varnish, grease, copper oxide, etc. This cleaning is easily conducted by brushing. In a preferred embodiment, cold brushing is conducted with nylon brushes having abrasive particles embedded in cured binders such as cured phenolformaldehyde resins, polyurethane resins and epoxy resins. These brushes may for instance be mechanically mounted on a driven roller bearing in mind that the copper metal must touch sideways in order to obtain good patina fixation and polishing could also be conducted if desired. Scoth Brite® brown pads may be used.

After removing any impurity present on the surface of the copper substrate, it should be borne in mind that the substrate must be manipulated with dirt free and grease free intermediates and never with hands; one may use metallic instruments or cotton gloves for instance.

After removal of the impurities, it is important to polish as quickly as possible the copper substrate with an aqueous solution containing sodium ions, copper ions, acetate ions, chloride ions, sulphate ions, hydrogen ions and hydroxy ions. This aqueous solution is preferably obtained by mixing from 100 to 150 ml of concentrated acetic acid, 500 to 600 grams of copper sulphate, 80 to 120 grams of sodium chloride, 11 to 13 grams of hydroxide and 11 to 15 grams of copper acetate in 4 liters of distilled water. More preferably, the solution contains 4 liters of distilled water, 135 ml of concentrated acetic acid, 563 grams of copper sulphate, 100 grams of sodium chloride, 12 grams of sodium hydroxide and 12 grams of copper acetate. The solution is applied in large quantity whether by jet, hand, mechanically or manually brushed until a brownish color is obtained. Thereafter, any excess of reactant is removed with thorough water washing. Drying is then conducted under air pressure over all coated surfaces and then the copper substrate is cured for at least 12 hours, preferably in a room having a light used for growing plants such as Gro-Lux ® Sylvania, simulating the solar light. Preferably, the sides of the room are reflecting light with surfaces such as mirror polished aluminum and the like. The room temperature is about 20° to 35° C. and preferably 25° C. with a relative humidity of between 35 to 80% and preferably 50%.

After the drying step, the copper substrate is thoroughly washed and lightly brushed, whether manually or mechanically, in order to remove brownish color which is not sufficiently adhering to the substrate. The substrate is then pressure air dried. Thereafter, the copper substrate is submitted to a filtered aqueous solution containing copper carbonate, ammonium chloride, copper acetate, arsenic trioxide, copper nitrate and hydrochloric acid until the desired patinated copper substrate is obtained. This last step may be repeated if desired. This solution may be applied with a brush or a gun as desired.

Preferably, this lost solution is obtained by mixing in 6 liters of distilled water, from 300 to 360 ml of concentrated hydrochloric acid, 100 to 160 grams of copper carbonate, 350 to 420 grams of ammonium chloride, 375 to 450 grams of copper acetate, 20 to 75 grams of arsenic trioxide, and 10 to 25 grams of copper nitrate. More preferably, the solution is prepared by mixing in 6 liters of distilled water, 330 ml of concentrated hydrochloric acid, 130 grams of copper carbonate, 400 grams of ammonium chloride, 400 grams of copper acetate, 65 grams of arsenic trioxide and 15 grams of copper nitrate. Then, the solution is left standing to reach equilibrium and filtered. As a practical method, a standing period of one day to ensure equilibrium is generally considered safe before filtration.

Thereafter, the copper substrate may be allowed to dry in the room as defined above for a period of 2 to 4 hours.

It is important to never handle the copper substrate with the hands during this process.

It should be noted that these drying stages may, if desired, be referred to as curing.

The day after, the patinate copper substrate is obtained. It may be placed in a warehouse protected with a paper in between.

Although the present invention has been explained hereinabove by way of preferred embodiments thereof, it should be pointed out that any modifications to these preferred embodiments, within the scope of the appended claims, is not deemed to change or alter the nature and scope of the invention.

I claim:

1. A method for artificially forming patina on copper comprising:

a) removing any impurity present on the surface of copper substrate;

b) polishing said copper substrate with an aqueous solution containing sodium ions, copper ions, acetate ions, chlorine ions, sulphate ions, $H+$ ions and an $OH-$ ions until a brown colour is obtained;

c) washing the polished copper substrate having brown colour of step b), washing and thoroughly drying; and d) gently brushing the copper substrate having been dried according to step c), washing it and thoroughly drying said washed substrate; and e) submitting said copper substrate after having been thoroughly dried according to step d), to a filtered aqueous solution containing copper carbonate, ammonium chloride, copper acetate, arsenic trioxide, copper nitrate and hydrochloric acid until the desired patinated copper substrate is obtained, wherein the aqueous solution used in step b) is obtained by mixing from 100 to 150 ml of concentrated acetic acid, 500 to 600 grams of copper sulfate, 80 to 120 grams of sodium chloride, 11 to 13 grams of sodium hydroxide and 11 to 15 grams of copper acetate in 4 liters of distilled water, and the aqueous solution used in step e) is obtained by mixing from 300 to 360 ml of concentrated hydrochloric acid, 100 to 160 grams of copper carbonate, 350 to 420 grams of ammonium chloride, 375 to 450 grams of copper acetate 20 to 75 grams of arsenic trioxide, and 10 to 25 grams of copper nitrate in 6 liters of distilled water.

2. The method as defined in claim 1, wherein step (b) is immediately conducted after step (a).

3. The method as defined in claim 1, wherein said step (a) consists in dry brushing the surface of said substrate.

4. The method as defined in claim 1, wherein said step (a) consists in brushings said copper substrate sideways with a brush of nylon fibers having abrasive parts bonded thereto with cured resinous binder.

5. The method as defined in claim 1, wherein said drying as defined under step (c) is conducted during a period of about half a day.

6. The method as defined in claim 1, wherein said step (e) is repeated.

7. The method as defined in claim 1, wherein said coating in step (b) is applied with an air jet.

8. The method as defined in claim 3, wherein said brushing in step (d) is mechanically conducted.

9. The method as defined in claim 1, wherein step (c), said drying is conducted with pressurized air after said washing, and then said substrate is placed for 12 hours at about room temperature under the presence of a light source.

10. The method as defined in claim 9 wherein said light source is a light used for growing plants.

* * * * *